United States Patent [19]

Albrecht

[11] 4,082,302

[45] Apr. 4, 1978

[54] SKI POLE

[75] Inventor: Alfred Albrecht, Riedholz, Switzerland

[73] Assignee: BFG Baumgartner Freres SA, Grenchen, Switzerland

[21] Appl. No.: 728,536

[22] Filed: Oct. 1, 1976

[30] Foreign Application Priority Data

Oct. 7, 1975 Switzerland ..... 12987/75

[51] Int. Cl.[2] ..... A63C 11/22

[52] U.S. Cl. ..... 280/11.37 H; 24/221 R; 135/66

[58] Field of Search ..... 280/11.37 E, 11.37 H, 280/11.37 D, 11.37 L, 11.37 R; 135/66, 76; 24/221 R, 113 MP, 90 A

[56] References Cited

U.S. PATENT DOCUMENTS

| | | | |
|---|---|---|---|
| 240,865 | 5/1881 | Strong | 24/221 R |
| 409,267 | 8/1889 | Allen | 135/66 |
| 1,062,903 | 5/1913 | Forsheim et al. | 135/76 |
| 3,685,850 | 8/1972 | Kepka | 280/11.37 H |
| 3,810,647 | 5/1974 | Martchenka | 280/11.37 E |
| 3,992,021 | 11/1976 | Tobin | 280/11.37 H |

FOREIGN PATENT DOCUMENTS

| | | | |
|---|---|---|---|
| 180,027 | 3/1954 | Austria | 280/11.37 E |
| 312,245 | 12/1956 | Switzerland | 280/11.37 H |

*Primary Examiner*—David M. Mitchell
*Attorney, Agent, or Firm*—Imirie, Smiley & Guay

[57] ABSTRACT

A ski pole having a handle on which a chronometer is detachably mounted. The chronometer is mounted by means of a bayonet fitting so arranged that the pushbutton is located so as to be actuatable by the thumb of the skier.

2 Claims, 4 Drawing Figures

FIG. 1
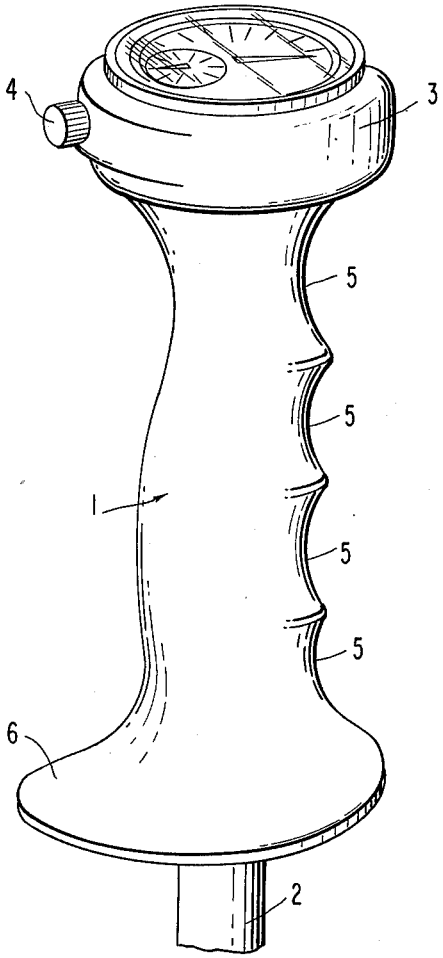
FIG. 2
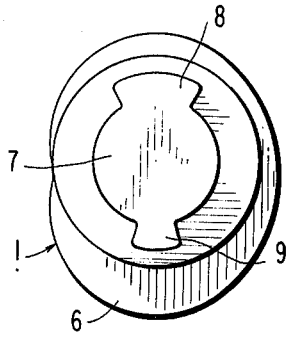
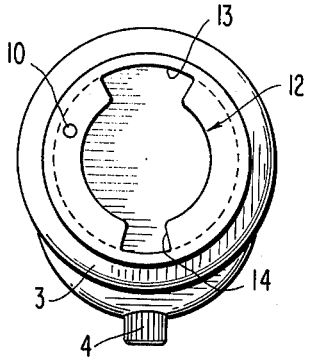
FIG. 3
FIG. 4
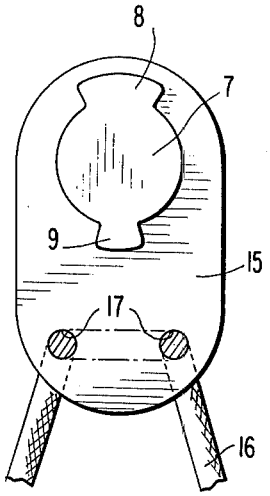

SKI POLE

BACKGROUND OF THE INVENTION

The present invention relates to a ski pole having a watch incorporated therein, which watch is removably mounted on the handle of the ski-stick.

With a conventional stop-watch a person is unable to control his travelling time accurately, since simultaneously actuating a stop-watch and pushing off with the ski poles is not possible. Moreover, it is possible only with considerable dfficulty, if not impossible, to check the times of certain sections of a run during travel along a downhill run and this generally necessitates an assistant. It is readily seen that with the proposed combination of a stop-watch with a ski pole a time check of any section is possible at any time.

To achieve the aforesaid object it would sufice to secure the stop-watch in any way, for example, by screws, to the ski pole handle. However, on the one hand, it is a pity to lose the usefulness of the stop-watch during the period in which there is no skiing, and, on the other hand, one would be virtually compelled to carry the ski-stick along everywhere when resting, say when entering a rest house, since the risk of loss is considerable. Thus, the stop-watch should preferably be removable.

SUMMARY OF THE INVENTION

According to the present invention there is provided a ski pole having a handle, in combination with a chronometer, the chronometer being detachably secured to the handle of the ski pole.

Preferably, the chronometer has a housing which is detachably connectable to the handle by means of a bayonet fitting.

BRIEF DESCRIPTION OF THE DRAWINGS

An embodiment of the invention is described below by way of example, with reference to the accompanying drawings, in which:

FIG. 1 shows a ski pole handle with a stop-watch;

FIG. 2 is a plan view of the pole handle without the stop-watch;

FIG. 3 shows the underside of the stop-watch with the closure part; and

FIG. 4 shows a carrier for the stop-watch.

DETAILED DESCRIPTION

FIG. 1 shows a handle 1 of a ski pole of which only a portion 2 is shown, and the handle 1 has a stop-watch 3 removably located thereon by means of a bayonet fitting. The bayonet fitting is so arranged that the push button 4 of the stop-watch can be actuated by the thumb. The ski pole preferably has four finger-grip portions 5 and a support plate 6. In the present embodiment the handle 1 is extruded from a plastics material composition.

FIG. 2 shows the closure part or boss 7 of the bayonet fitting provided on the handle, which part 7 has two cams or lugs 8, 9 of different sizes. The different width of the cams or lugs 8 and 9 serves the accurate positioning of the stop-watch relative to the handle 1. Instead of being made integrally with the handle, the closure part or boss 7 of the bayonet fitting may also be made as a separate part, for example, of metal and screwed onto the handle.

FIG. 3 shows the stop-watch housing 3 with the receiving part 12 of the bayonet fitting, with two recesses or notches 13 and 14 of different width, so that the cams or lugs 8, 9 fit into the recesses or notches 13 and 14 respectively. Both the housing of the stop-watch 3 and the receiving part 12 are made of the same plastics material as the handle. Moreover, the receiving part 12 has a positioning pin 10.

Owing to the fact that the stop-watch is easily removed, the risk of theft is reduced, and the stop-watch may also be used for other purposes. Thus, this chronometer, normally a stop-watch, may be carried in the hand or put into a pocket, or it may be placed on a carrier 15 made of plastics material (FIG. 4). This carrier 15 has the same bayonet fitting part 7, 8 and 9 as the ski pole handle. The carrier 15 may be provided with a cord 16 to enable it to be carried round the neck, for example, or the two holes 17 may be used for securing it to a wall, for example, or in a car by means of screws. The cord 16 should have a clasp and be removable from the carrier 15.

If the chronometer is not required on the ski pole, for example, when skiing in the ordinary way or long distance skiing, it is expedient to protect the locking part 7 from contamination. For this purpose a plastics material cap (not shown herein) is provided having the same receiving part 12 as the housing 3. In a particular preferred embodiment which is already prescribed in various countries, the ski pole has a removable safety loop, not shown herein, whilst the tip no longer extends into a point, but is cut off and provided on the end face with ribs.

Other types of closures are possible, such as, for example, screw closures and the selection of the chronometer device is not limited to a stop-watch as shown herein. More particularly, chronometers having several pushbuttons may also be provided, and it is not necessary for all the parts to be made of plastics material, other materials such as, for example, metal or metal and leather or synthetic leather are possible.

I claim:

1. A ski pole comprising a pole having a handle on the upper end thereof, the end of said handle which is opposite the end connected to said pole being free, a chronometer enclosed within a casing including a front wall having an opening for exposing the face of the chronometer and a back wall that is engagable with the free end of said handle, and bayonet locking means releasably securing said chronometer casing back wall to the free end of said handle and including a bayonet fitting protruding longitudinally from said handle and a cooperative bayonet fitting recessed in the back wall of said chronometer casing, whereby said casing is devoid of protrusions when the chronometer is removed from said handle.

2. A ski pole according to claim 1 wherein said handle has finger grip portions along one side thereof and a smooth portion opposite said finger portions for engagement with the butt of the operators thumb, said bayonet fitting on said handle comprising a circular boss having at least two radially extending lugs of different sizes, said chronometer being constituted by a stop watch having a radially disposed pushbutton for actuating said watch, the bayonet fitting in said casing comprising a circular central opening with radially disposed notches so located and of a size respectively corresponding to said lugs to permit insertion of said boss and lugs only in the correct manner, said respective bayonet fittings being so oriented relative to said finger portions and said pushbutton that said pushbutton is aligned with said smooth handle portion when said stop watch is locked to said handle to be readily accessible to the operators thumb.

* * * * *